United States Patent [19]

Hayashi et al.

[11] Patent Number: 4,783,006

[45] Date of Patent: Nov. 8, 1988

[54] MIST SUPPLYING DEVICE FOR FORMING THIN FILM

[75] Inventors: Yutaka Hayashi, Ibaraki; Atuo Itoh, Tokyo; Hideyo Iida, Tokyo; Kikuji Fukai, Tokyo, all of Japan

[73] Assignees: President of Kogyo Gijutuin; Taiyo Yuden Kabushiki Kaisha, both of Tokyo, Japan

[21] Appl. No.: 68,466

[22] Filed: Jun. 30, 1987

[30] Foreign Application Priority Data

Jul. 9, 1986 [JP] Japan ..... 61-161162

[51] Int. Cl.[4] ..... B05B 1/00; B05B 1/34

[52] U.S. Cl. ..... 239/380; 239/432; 239/590; 239/592; 239/597; 366/332; 366/340; 118/300; 118/715; 261/81

[58] Field of Search ..... 239/102.1, 380, 590.3, 239/592, 597, 432; 366/332, 340; 118/300, 715; 261/81

[56] References Cited

U.S. PATENT DOCUMENTS 3,917,888 11/1975 Beam et al. ..... 239/592 X
4,562,095 12/1985 Coulon et al. ..... 239/597 X
4,624,213 11/1986 Long et al. ..... 118/300
4,649,857 3/1987 Hayashi et al. .

FOREIGN PATENT DOCUMENTS 61-3885 1/1986 Japan ..... 118/300

*Primary Examiner*—Andres Kashnikow
*Assistant Examiner*—Mary B. D. Jones
*Attorney, Agent, or Firm*—Flynn, Thiel Boutell & Tanis

[57] ABSTRACT

A mist supplying device for supplying a film-forming solution to form a thin film on a substrate includes a nozzle having an elongate outlet port, an atomizer coupled to the nozzle for atomizing the film-forming solution, and a disperser movably disposed in the nozzle between the outlet port and the atomizer and having a plurality of substantially uniformly distributed mist passages for passing the atomized film-forming solution in a first flow passage direction therethrough. An air blower is coupled to the atomizer for delivering the atomized film-forming solution into the nozzle. A driver unit is coupled to the disperser for reciprocally moving the mist passages in a second flow passage direction transverse to the first flow passage direction.

5 Claims, 2 Drawing Sheets

MIST SUPPLYING DEVICE FOR FORMING THIN FILM

BACKGROUND OF THE INVENTION

1. Field of the Invention

The present invention relates to a mist supplying device for applying an atomizing film-forming solution to a surface of a heated substrate to form a thin film of $SnO_2$, $In_2O_3$, $TiO_2$, $SiO_2$, or the like thereon.

2. Description of the Prior Art

FIG. 5 of the accompanying drawings illustrates a conventional apparatus for forming a thin film, the apparatus including a mist supplying device. The thin film forming apparatus has a reaction chamber 1 accomodating therein a plurality of substrates 2 with their surfaces to be coated with thin films being directed downwardly. The substrates 2 are fed through the reaction chamber 1 from right to left or left to right in FIG. 5. The substrates 2 are heated in the reaction chamber 1 to a temperature ranging from 400° to 500° C. by a heater 9 located behind the substrates 2. A nozzle 6 disposed downwardly of the substrates 2 in the reaction chamber 1 has an outlet port 7 toward the surfaces of the substrates 2. The nozzle 6 is coupled to an atomizer 4 and an air blower 5.

A film-forming solution to be applied to the substrates 2 is a solution of a chloride such as Sn, In, or the like. The solution is atomized in the atomizer 4 and fed to the nozzle 6 by the air blower 5. The atomized solution is then gradually applied from the outlet port 7 of the nozzle 6 to the surface of the substrates 2. Part of the atomized solution is dehydrated and vaporized by absorbing heat in the vicinity of the surfaces of the substrates 2. The vaporized solution reacts with oxygen and water vapor to form an oxidized film of $SnO_2$, $InO_3$, or the like which is attached to the surfaces of the substrates 2.

The thin film of $SnO_2$ or $InO_3$ is transparent. Therefore, if the deposited thin film is irregular in thickness, it will produce varying electric resistances and dielectric constants, and also form interference fringes that make the film poor in appearance. With a view to forming a thin film of uniform thickness, there has been attempted to provide a screen 8 in the nozzle 6 for evenly dispersing the atomized solution to apply the same uniformly to the surfaces of the substrates 2.

In the thin film forming apparatus shown in FIG. 5, the atomized solution is supplied onto the surfaces of the substrates 2 while the substrates 2 are being progressively delivered from right to left or left to right as shown. Thus, the film thickness is less likely to become irregular in the direction in which the substrates 2 are fed.

However, there is a greater tendency for the deposited film to have thickness irregularities in a direction perpendicular to the direction of feed of the substrates 2 due, for example, to a localized flow of the atomized solution from the atomizer 4, which may happen even if the screen 8 is present. Such thickness irregularities are apt to produce interference fringes along the direction of feed of the substrates 2.

SUMMARY OF THE INVENTION

In view of the drawback of the conventional thin film forming apparatus, it is an object of the present invention to provide a mist supplying device capable of forming, on substrates, a thin film of uniform thickness in a direction perpendicular to the direction in which the substrates are fed.

According to the present invention, a mist supplying device for supplying a film-forming solution to form a thin film on a substrate includes a nozzle having an elongate outlet port and an atomizer coupled to the nozzle for atomizing the film-forming solution, a disperser movably disposed in the nozzle between the outlet port and the atomizer and having a plurality of substantially uniformly distributed mist passages for passing the atomized film-forming solution in a first flow passage direction therethrough, the first flow passage direction being the direction of the mist flowed through the mist passages and the nozzle, an air blower coupled to the atomizer for delivering the atomized film-forming solution into the nozzle, and a driver unit coupled to the disperser for reciprocally moving the mist passages in a second flow passage direction transverse to the first flow passage direction, the second flow passage direction being the flow passage direction parallel to the longitudinal direction of the outlet port.

The disperser comprises a frame movably supported in the nozzle and a screen supported by the frame and having the mist passages.

Alternatively, a screen is fixedly mounted in the nozzle below the disperser, and the disperser comprises a rotatable rod mounted in the nozzle and a plurality of vanes mounted on the rod at spaced intervals and defining the mist passages therebetween.

As a further alternative, a screen is fixedly mounted in the nozzle below the disperser, and the disperser comprises a longitudinally movable rod mounted in the nozzle and movable to the second flow passage direction and a plurality of branch teeth extending radially outwardly from the rod and defining the mist passages therebetween.

The disperser is reciprocally moved by the driver unit to move the mist passages back and forth. Therefore, the atomized film-forming solution, as it emerges from the mist passages, is well agitated thereby and is discharged as a film-forming mist which is uniform in density in the longitudinal direction of the outlet port. The outlet port is directed perpendicularly or substantially perpendicularly to the direction in which the substrate is fed, so that the thin film deposited on the substrate by the atomized solution emitted from the outlet port is also of an uniform thickness in the direction normal to the direction of feed of the substrate.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
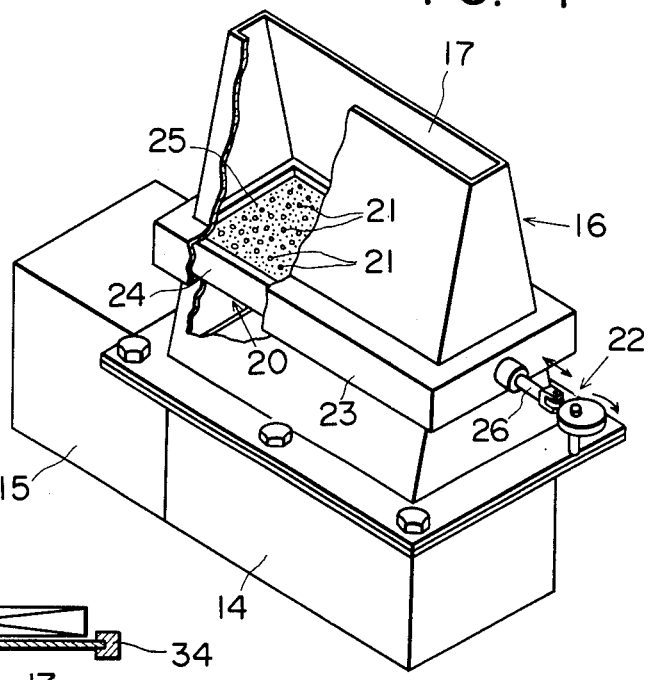
FIG. 1 is a perspective view, partly broken away, of a mist supplying device according to an embodiment of the present invention.

Like or corresponding parts are denoted by like or corresponding reference numerals throughout several views.

Figure 2:
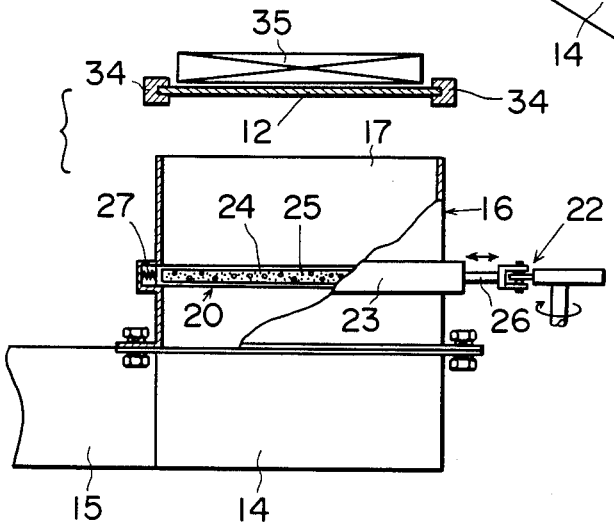
FIG. 2 is a side elevational view, partly in vertical cross section, of the mist supplying device.

FIGS. 1 and 2 show a mist supplying device according to an embodiment of the present invention. The mist supplying device comprises a nozzle 16 having an outlet port or slot 17, an atomizer 14 connected to the nozzle 16 for atomizing a film-forming solution to be delivered to the nozzle 16, and an air blower 15 coupled to the atomizer 14 for feeding the atomized solution from the atomizer 14 to the nozzle 16.

The outlet port 17 is of a narrow elongate shape and is defined at the upper end of the nozzle 16. The nozzle 16 is generally of a wedge-shaped hollow structure tapered toward the outlet port 17 and has its lower end fastened to the atomizer 14. The nozzle 16 includes a rectangular disperser casing 23 defined on a vertically intermediate portion thereof as an outwardly projecting housing. The disperser 20 vertically positioned between the outlet port 17 and the atomizer 14. The disperser 20 comprises a rectangular plate-like screen 25 and a frame 24 extending around and supporting therein the screen 25, the screen 25 having a multiplicity of minute mist passages 21 defined transversely therethrough. The disperser 20 is coupled to a driver unit 22 which can move the disperser 20 back and forth in the longitudinal direction of the outlet port 17.

The screen 25 is made of a porous material such as ceramics with the mist passages 21 distributed uniformly therein. The frame 24 has one longitudinal and coupled through a rod 26 to the driver unit 22, which comprises a cam mechanism actuatable by a motor or the like (not shown). A compression coil spring 27 is interposed between the other longitudinal end of the frame 24 and the confronting wall of the casing 23. Thus, the disperser 20 can be reciprocally moved horizontally (FIG. 2) through the coaction of the driver unit 22 and the compression coil spring 27.

As shown in FIG. 2, two spaced guide rails 34 are disposed above the mist supplying device of the invention for supporting substrates 12 movably on their opposite sides. The substrates 12 can be fed successively along the guide rails 34 in a direction toward the viewer of FIG. 2. A heater 35 is positioned over the substrates 12 to heat them at their backs. The nozzle 16, the guide rails 34, and the heater 35 are housed in a reaction chamber (not illustrated).

Operation of the mist supplying device shown in FIGS. 1 and 2 is as follows. As illustrated in FIG. 2, the nozzle 16 is located below a substrate 12 supported on the guide rails 34 with the surfaces of the substrates 12 to be coated with thin films being directed downwardly. At this time, the elongate outlet port 17 of the nozzle 16 is directed toward the substrate 12 with the longitudinal axis of the port 17 being oriented perpendicularly, or substantially perpendicularly, to the direction of feed of the substrate 12. Thus, as substrates 12 are fed toward the viewer of FIG. 2 while being supported on their sides by the guide rails 34, the outlet port 17 of the nozzle 16 which extend perpendicularly to the direction in which the substrates 12 are delivered traverses the substrates 12 successively.

The disperser 20 is moved back and forth by the driver unit 22 to cause the mist passages 21 to move in the second direction transverse to the first direction. At the same time, an atomized film-forming solution from the atomizer 14 is delivered by the air blower 15 into the nozzle 16. The solution mist in the nozzle 16 passes through the uniformly distributed mist passages 21 in the disperser 20 and is supplied through the outlet port 17 onto the surface of the substrate 12 which is located above the outlet port 17. Since the mist passages 21 are moved back and forth in the longitudinal direction of the outlet port 17 or in the second flow passage direction, the mist as it emerges from the disperser 20 is agitated in the direction of reciprocating movement of the disperser 20. Therefore, even if the mist flow supplied to the nozzle 16 is somewhat localized or otherwise made irregular, the mist upon leaving the disperser 20 is uniform in the direction of the outlet port 17, and hence, uniform mist is discharged from the outlet port 17.

Figure 3:
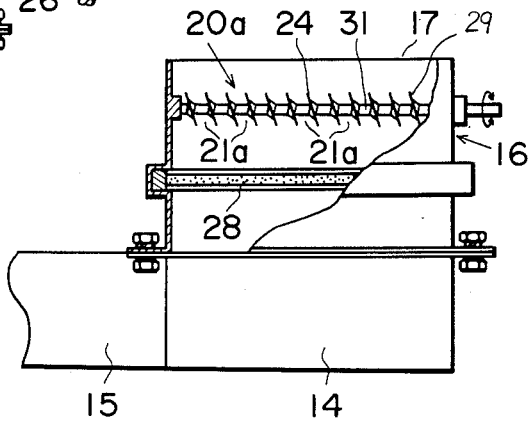
FIG. 3 is a view similar to FIG. 2, showing a mist supplying device according to another embodimeNT of the present invention.

FIG. 3 shows a mist supplying device according to another embodiment of the present invention. In this embodiment, a disperser **20*a* is rotatably mounted in the nozzle 16 above a screen 28 fixedly disposed in the nozzle 16 in its vertically intermediate portion. The disperser 20*a* comprises a rotatable shaft 31 extending horizontally in the longitudinal direction of the outlet port 17 and movable in the second flow passage direction and supporting screw-like vanes 29 thereon. The shaft 31 has one end projecting out of the nozzle 16 and coupled to a driver unit (not shown) comprising a motor or the like having a reversible rotating mechanism. The vanes 29 are spaced at regular intervals or pitches in the longitudinal direction of the shaft 31 or in the second flow passage direction to define relatively large mist passages 21*a* between the vanes 29. The mist passages 21*a* can reciprocally be moved in the longitudinal direction of the outlet port 17 or in the second flow passage direction in response to reversible rotation of the shaft 31** about its own axis, caused by the driver unit.

Figure 4:
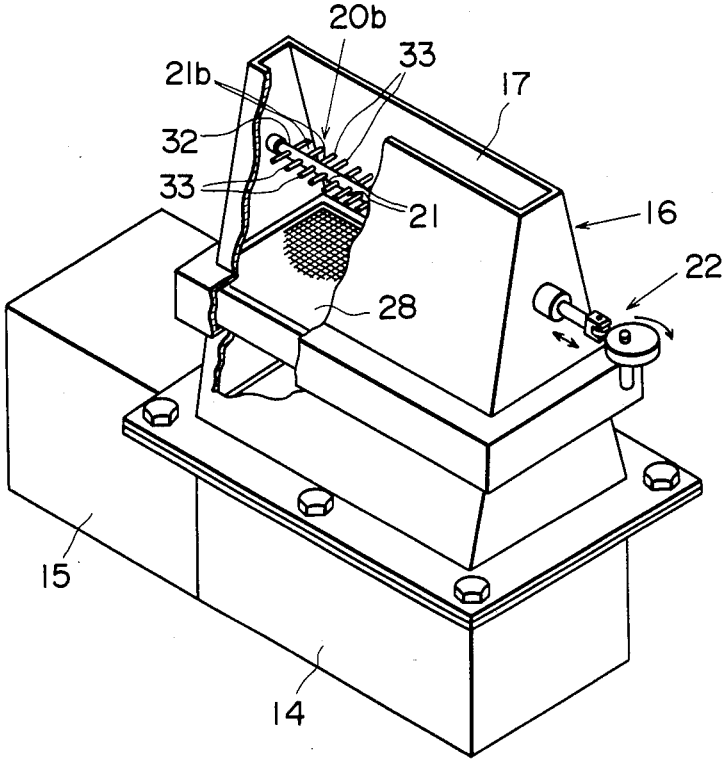
FIG. 4 is a perspective view, partly broken away, of a mist supplying device according to still another embodiment of the present invention.
Figure 5:
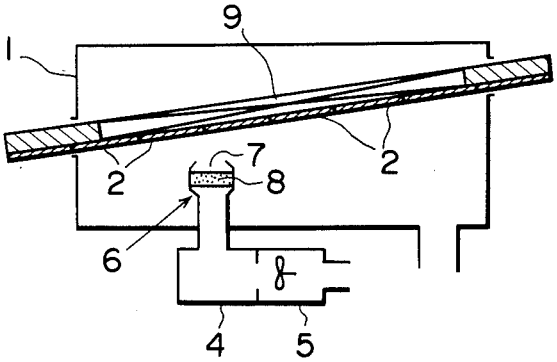
FIG. 5 (PRIOR ART)
FIG. 5 is a schematic vertical cross-sectional view of a conventional thin film forming apparatus including a mist supplying device as shown in U.S. Pat. No. 4,649,857.

According to still another embodiment illustrated in FIG. 4, a disperser **20*b* is axially movably mounted in the nozzle 16 above the fixed screen 28. The disperser 20*b* comprises a rod 32 longitudinally or in the second flow passage direction movably supported in the nozzle 16 and having one end projecting out of the nozzle 16 and coupled to the driver unit 22 of the same structure as shown in FIG. 1. The rod 32 supports a plurality of spaced branch teeth 33 extending radially outwardly in opposite directions to define relatively large mist passages 21*b* between the bars 33. When the driver unit 22 is operated, the disperser 20*b* is moved back and forth or in the second flow passage direction to move the mist passages 21*b*** reciprocally.

The cyclic period and stroke of reciprocating movement of the dispersers **20*a*, 20*b* vary dependent on the configuration thereof and the size of the mist passages 21*a*, 21*b*. Generally, however, as the mist passages 21*a*, 21*b* are smaller, the dispersers 20*a*, 20*b* are more slowly moved back and forth in smaller strokes. Conversely, as the mist passages 21*a*, 21*b* are larger, the dispersers 20*a*, 20*b*** are more quickly moved back and forth in greater strokes.

Experiments were conducted to form thin films on substrates, using the mist supplying devices shown in FIGS. 1 and 2 and FIG. 3. As a result, it was confirmed that no interference fringes were produced in the direction in which substrates 12 were fed, and thin films of uniform thickness were formed on the substrates 2. For the mist supplying device of FIGS. 1 and 2, the disperser 20 was reciprocally moved three times per second in a stroke of 10 mm, and for the mist supplying device of FIG. 3, the disperser 20*a* was rotated five times per second and the direction of rotation was changed in every second.

Although certain preferred embodiments have been shown and described, it should be understood that many changes and modifications may be made therein without departing from the scope of the appended claims.

What is claimed is:

1. A mist supplying device for supplying a film-forming solution to form a thin film on a substrate, comprising:

a nozzle having an elongate outlet port;

an atomized coupled to said nozzle for atomizing a film-forming solution;

a disperser movably disposed in said nozzle between said outlet port and said atomizer and having a plurality of substantially uniformly distributed mist passages for passing the atomized film-forming solution in a first flow passage direction therethrough and forming a mist, said first flow passage direction being the direction of the mist flowed through said mist passages and said nozzle;

an air blower coupled to said atomizer for delivering the atomized film-forming solution into said nozzle; and a driver unit coupled to said disperser for reciprocally moving said mist passages in a second flow passage direction transverse to said first flow passage direction, said second flow passage direction being the direction parallel to the direction of elongation of said elongate outlet port.

2. A mist supplying device according to claim 1, further including a screen fixedly mounted in said nozzle below said disperser, said disperser comprising a rod mounted in said nozzle movable in the second flow passage direction and a plurality of branch teeth extending radially outwardly from said rod and defining said mist passages therebetween.

3. A mist supplying device according to claim 1, wherein said nozzle is wedge shaped and tapers toward said outlet port, said atomizer being coupled to an end of said nozzle is remote from said outlet port.

4. A mist supplying device for supplying a film-forming solution to form a thin film on a substrate, comprising:

a nozzle having an elongate outlet port;

an atomizer coupled to said nozzle for atomizing a film-forming solution;

a disperser movably disposed in said nozzle between said outlet port and said atomizer and having a rotatable rod mounted in said nozzle, said rotatable rod having a plurality of vanes mounted thereon and defining a plurality of substantially uniformly distributed mist passages therebetween for passing the atomized film-forming solution in a first flow passage direction therethrough and forming a mist, said first flow passage direction being the direction of the mist flowed through said mist passages and said nozzle;

a screen fixedly mounted in said nozzle below said disperser;

an air blower coupled to said atomizer for delivering the atomized film-forming solution into said nozzle; and a driver unit coupled to said disperser for rotatably moving said rotatable rod and thereby moving said mist passages in a second flow passage direction transverse to said first flow passage direction, said second flow passage direction being the direction parallel to the direction of elongation of said elongate outlet port.

5. A mist supplying device for supplying a film-forming solution to form a thin film on a substrate, comprising:

a nozzle having an elongate outlet port;

an atomizer coupled to said nozzle for atomizing a film-forming solution;

a disperser comprising a frame movably supported in said nozzle between said outlet port and said atomizer and a screen supported by said frame, said screen having a plurality of substantially uniformly distributed mist passages for passing the film-forming solution in a first flow passage direction therethrough, said first flow passage direction being the direction of mist flowed through said mist passages and said nozzle;

an air blower coupled to said atomizer for delivering the atomized film-forming solution into said nozzle; and a driver unit coupled to said dispenser for reciprocally moving said mist passages in a second flow passage direction transverse to said first flow passage direction, said second flow passage direction being the direction parallel to the direction of elongation of said elongate outlet port.

* * * * *

UNITED STATES PATENT AND TRADEMARK OFFICE

CERTIFICATE OF CORRECTION

PATENT NO. : 4 783 006

DATED : November 8, 1988

INVENTOR(S) : Yutaka Hayashi et al

It is certified that error appears in the above-identified patent and that said Letters Patent is hereby corrected as shown below:

Column 5, line 22; change "atomized" to ---atomizer---.

Signed and Sealed this

Fifth Day of September, 1989

*Attest:*

DONALD J. QUIGG

*Attesting Officer*

*Commissioner of Patents and Trademarks*